US006655521B2

(12) United States Patent
Ulrich et al.

(10) Patent No.: US 6,655,521 B2
(45) Date of Patent: Dec. 2, 2003

(54) ESCALATOR OR MOVING WALKWAY

(75) Inventors: Robert Ulrich, Bruck Neudorf (AT); Kurt Streibig, Vienna (AT); Thomas Illedits, Neufeld an der Leitha (AT)

(73) Assignee: Inventio AG, Hergiswil NW (CH)

( * ) Notice: Subject to any disclaimer, the term of this patent is extended or adjusted under 35 U.S.C. 154(b) by 0 days.

(21) Appl. No.: 10/120,177

(22) Filed: Apr. 10, 2002

(65) Prior Publication Data

US 2002/0148703 A1 Oct. 17, 2002

(30) Foreign Application Priority Data

Apr. 11, 2001 (EP) ..... 01810361

(51) Int. Cl.[7] ..... B66B 21/00
(52) U.S. Cl. ..... 198/326
(58) Field of Search ..... 198/326

(56) References Cited

U.S. PATENT DOCUMENTS 3,651,919 A * 3/1972 Vollmer ..... 198/331
3,653,484 A * 4/1972 Taylor ..... 198/335
4,475,777 A 10/1984 Hofmann et al.
5,072,821 A * 12/1991 Kruse et al. ..... 198/327
5,131,521 A * 7/1992 Johnson et al. ..... 198/335
5,341,909 A * 8/1994 Ahls et al. ..... 198/335
5,379,877 A * 1/1995 Hoefling ..... 198/330
5,622,246 A * 4/1997 Kubota ..... 198/321
5,924,544 A * 7/1999 Kwon ..... 198/326
6,357,572 B2 * 3/2002 Kubota ..... 198/321

FOREIGN PATENT DOCUMENTS

GB 891660 3/1962

OTHER PUBLICATIONS

Patent Abstracts of Japan, Pub. No. 06144762, May 24 1994 "Guide Rail For Escalator And The Like".

* cited by examiner

*Primary Examiner*—Joseph A. Dillon
(74) *Attorney, Agent, or Firm*—Schweitzer Cornman Gross & Bondell, LLP

(57) ABSTRACT

An escalator or moving walkway includes, divided roller bearings to improve the efficiency of replacement thereof. The roller bearings may be located in the region of the drive axle or deflecting axle of the step chain. The divided roller bearing components can be mounted on the roller bearing axle, and removed therefrom, in radial direction.

12 Claims, 10 Drawing Sheets

ESCALATOR OR MOVING WALKWAY

The invention relates to an escalator or a moving walkway comprising at least one roller bearing which is mounted between an axle or a shaft and at least one further constructional element.

In the further description the term 'escalator' also includes 'moving walkway' and the term 'step' also includes 'moving walkway pallets'.

BACKGROUND OF THE INVENTION

The steps of a conventional escalator are fastened to two transport chains and form together therewith an endless, circulating step belt which runs over a respective pair of transport chainwheels at each of the two ends of the escalator, wherein one transport chainwheel pair belongs to the drive station and drives and deflects the step belt, and the other chainwheel pair is part of a step belt return station. The individual steps of the step belt are each equipped with two respective front and two respective rear guide rollers, at which the steps are guided in a location, which is defined in dependence on position by guide runners and deflecting runners primarily fastened to the support construction of the escalator.

Roller bearings are used at various places in escalators, for example for mounting the transport chain drive wheels or the transport chain deflecting wheels.

There is known from JP 06144762 a use of roller bearings in guide equipment which defines the path of the rear guide rollers of escalator steps in the region of the step belt return station. The U-shaped deflecting runners are not, in that case, fixedly secured to the support construction of the escalator, but arranged to be horizontally displaceable thereat between the transport chain deflecting wheels and coupled by way of roller bearings with the axle of the transport chain deflecting wheels. This axle is displaceable transversely to the axial direction for tensioning the transport chains. Relative movement between the deflecting wheels and deflecting runners during tensioning of the transport runners is avoided by the mentioned coupling between the axle of the transport chain deflecting wheels and the U-shaped deflecting runners. An always constant movement path of the steps in the region of the step belt return is thereby guaranteed without the deflecting runners having to be manually readjusted in the case of retensioning necessitated by operationally-caused chain elongation.

The described construction has the disadvantage that in the case of a roller bearing defect extensive demounting and mounting operations are required, since the roller bearings can be removed and refitted only by longitudinal displacement to the axle end. The demand for short interruption times for rectification of every form of possible defect cannot be fulfilled with this construction.

The present invention has the object of avoiding the stated disadvantage in an escalator or a moving walkway, i.e. of enabling the exchange of a defective roller bearing in substantially reduced time.

BRIEF DESCRIPTION OF THE INVENTION

The object of the invention is met by a construction having a divided roller bearing mounted between an axle or shaft of an escalator or moving walkway and a further constructional element, whereby the roller bearing elements are mountable and demountable in a radial direction.

Significant advantages are achieved in an escalator according to the invention if step guide equipment, which is present in the region of the step belt return station for guidance of the guide rollers mounted at the steps of the step belt, is coupled with the deflecting axle of the transport chain deflecting wheels by way of at least one divided roller bearing, whereby the correct relative position between step guide equipment and transport chain deflecting wheels is ensured at all times.

The solution according to the invention has proved particularly advantageous in the case of an escalator in which the step guide equipment is coupled by way of roller bearings with a deflecting axle, which is displaceable transversely to the axial direction thereof for tensioning of the transport chains, of the transport chain deflecting wheels, whereby readjustment of the step guide equipment after retensioning of the transport chains has been carried out is superfluous.

According to an advantageous embodiment of the escalator according to the invention each bearing housing of the roller bearing connecting the step guide equipment with the said deflecting axle consists of two differently shaped flanges which are flanged to one another at end faces oriented at right angles to the bearing axis and are connected together by screws. In that case a respective first flange is directly connected with the step guide equipment and a respective second flange is formed to be of hollow cylindrical shape and receives the entire roller bearing. After release of the screw connection between the two flanges of a bearing housing the flange of hollow cylindrical shape can be pulled off the roller bearing in axial direction so that the roller bearing is exposed for demounting.

A particularly simple axial fixing of the roller bearing, which connects the step guide equipment with the said deflecting axle, on the deflecting axle of the transport chain deflecting wheels is achieved if the inner ring halves of the roller bearings are mounted in recesses in this deflecting axle.

In advantageous manner the transport chain drive wheels are mounted by way of divided roller bearings on a stationary central axle in an escalator according to the invention. It is thereby achieved that, in installation situations where the escalator is not laterally accessible in the region of the transport chain drive wheels, the roller bearings can be drawn out of the bearing housings from the escalator inner side in direction towards the axle centre and can be remounted in reverse direction.

A particularly stable construction of a transport chain drive wheel unit results if the two transport chain drive wheels are connected together by means of a hollow shaft. The large torsional stiffness of such a hollow shaft guarantees perfect synchronism of the transport chains, and problems with worn-out shaft/hub connections of customary kind are avoided by the screw connection between hollow shaft and transport chain drive wheels of large flange diameters.

In order to be able to withdraw the roller bearings from their bearing seats in the direction of the axle centre and remove and reinstall their subsequently divided components for a roller bearing change in a transport chain drive wheel unit with a hollow shaft, a respective through-opening penetrating the cylinder wall of the hollow shaft is present in each of the two end regions of the hollow shaft.

A particularly advantageous embodiment of the invention consists in that the hollow shaft connected with the transport chain drive wheels has in its cylinder wall at least two groups of radially arranged threads with setting screws, with the help of which the hollow shaft and the transport chain drive wheels are supported on the stationary drive wheel axle before removal of the roller bearings. A roller bearing change can thus be performed without the transport chains having to be removed from the transport chain drive wheels or the latter having to be fixed by involved measures.

According to an advantageous development of the invention parallel bores are arranged in the component, which contains the bearing seat for the outer ring of a divided roller bearing, around this bearing seat, wherein a parallel, slot-shaped channel is present between each of these bores and the bearing seat. Inserted into each bore is a withdrawal device which fits therein and has at one end a form of nose which engages behind that end face of the outer ring of the roller bearing which lies more deeply in the bearing seat. The withdrawal device includes an axial thread and a withdrawal screw which co-operates therewith and which is supported by its end in the interior of the bearing seat component. Through rotation of this withdrawal screw there is effected an axial movement of the withdrawal device which in that case moves, by its nose, the outer ring out of the bearing seat.

BRIEF DESCRIPTION OF THE DRAWINGS

Illustrative embodiments of the invention are illustrated in FIGS. 1 to 10 and explained in more detail in the following description.

DETAILED DESCRIPTION OF THE INVENTION

By "divided roller bearing" there is to be understood a roller bearing in which an inner ring, the roller body cage and an outer ring are each divided into two halves, so that all components of the roller bearing can be fitted in radial direction onto an axle or a shaft and removed again therefrom, wherein generally the inner ring halves and also the outer ring halves are connected together by screws.

Figure 1:
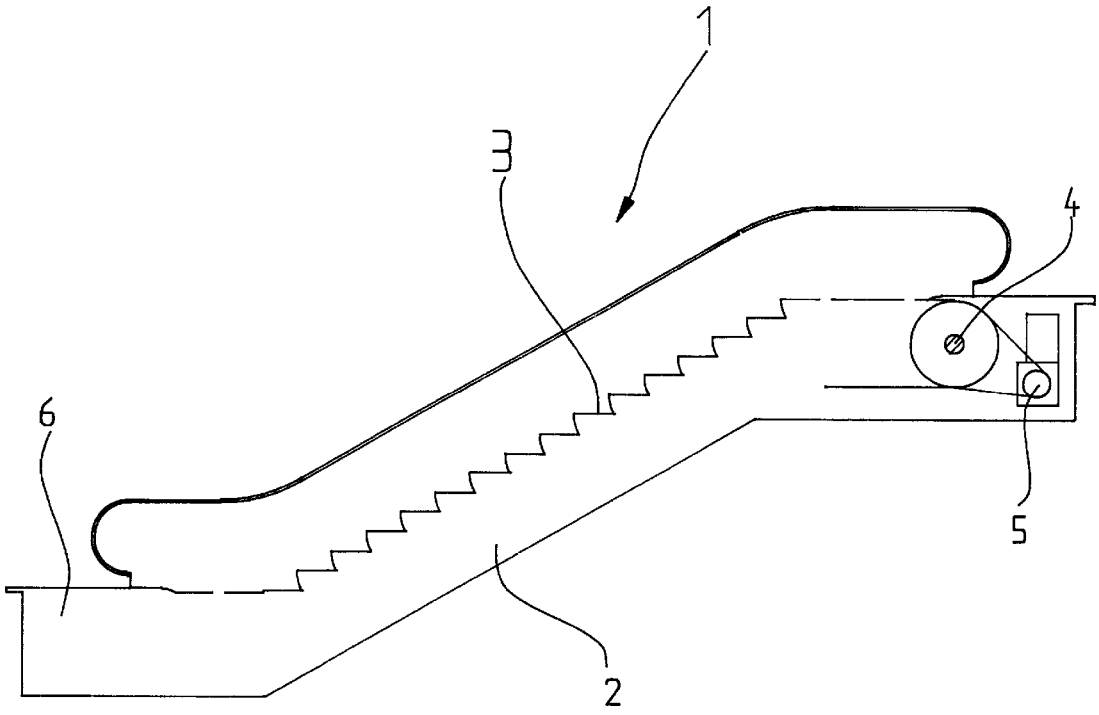
FIG. 1 shows a general arrangement of an escalator.

The most essential components of an escalator or moving walkway 1 are schematically illustrated in FIG. 1. Integrated in an escalator support construction 2 is a circulating, endless step or pallet belt 3 which is driven by a driven unit 5 by way of a transport chain drive wheel unit 4. The region of a step or pallet belt return station is denoted by 6. in the further description the term "escalator" shall also include "moving walkway" and the tem "step" shall also include the term "moving walkway pallets."

Figure 2:
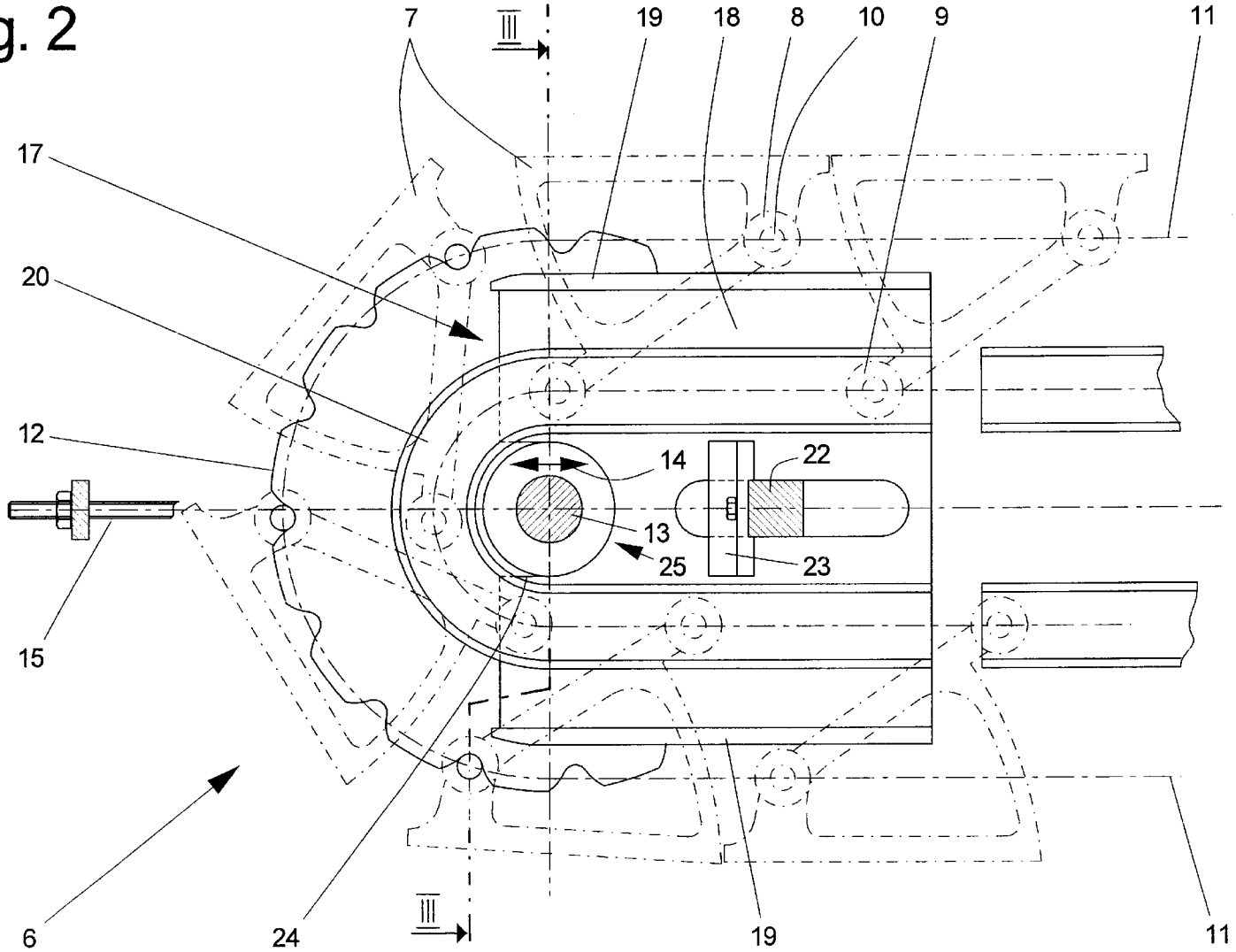
FIG. 2 shows, as a longitudinal section through the escalator, the region of the non-driven step belt return station with the step guide equipment and the displaceable deflecting axle.
Figure 3:
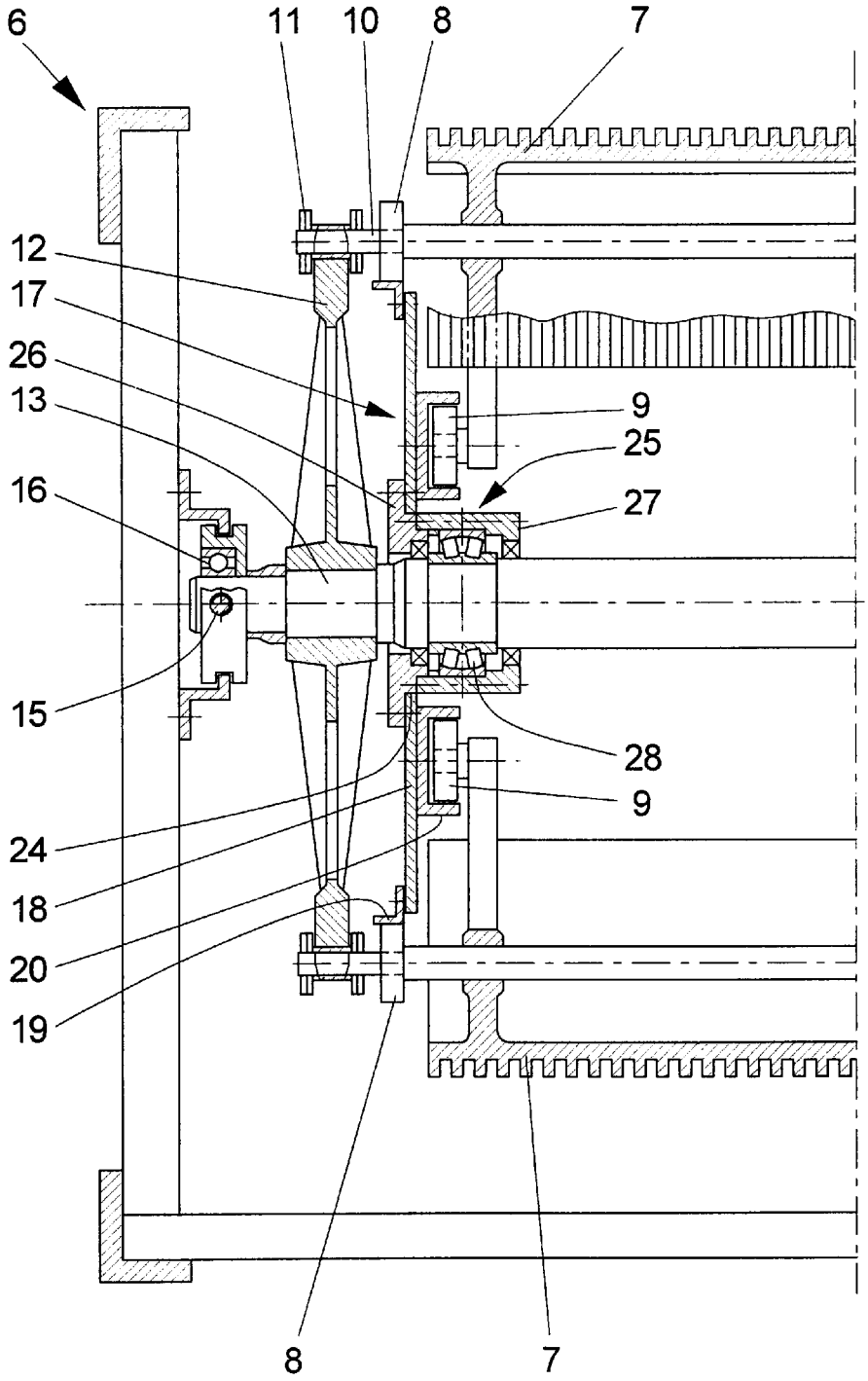
FIG. 3 shows, as a section through the escalator along the line III—III in FIG. 2, the region of the non-driven step belt return station with the step guide device, the displaceable return axle and the divided roller bearing which couples the step guide element with the deflecting axle.

FIG. 2 shows a longitudinal section through the escalator in the region of the non-driven step belt return station 6 having the step guide equipment 17, and FIG. 3 shows the same region as a section through the escalator along the line III—III in FIG. 2. The steps of the step belt, which each have two respective front guide rollers 8 and two respective rear guide rollers 9, are denoted by 7. The steps 7 are coupled to two circulating transport chains 11 by way of extensions of the roller axles 10 of the front guide rollers 8. One of the two transport chain deflecting wheels 12, which are fixed on a common deflecting axle 13, is seen in FIG. 2 and FIG. 3. The deflecting axle 13 is displaceable in the direction of the arrow 14 in FIG. 2 so that the transport chains 11 can be tensioned after assembly of the escalator has been carried out and compensation can be later provided for chain elongation caused by operation. An adjusting spindle of a tensioning device is schematically indicated by 15 and serves for displacing the displaceable axial bearing 16 of said deflecting axle 13. In addition, there is illustrated the step guide equipment 17 which essentially consists of two plate-shaped side panels 18 with first roller guide elements 19, which are mounted thereon, for the front guide rollers 8 and second roller guide elements 20, which are laterally displaced relative thereto, for the rear guide rollers 9. The two side panels 18 are arranged between the two transport chain deflecting wheels 12 and are supported on a cross-member 22, which is rigidly connected with the support construction 2, to be displaceable in the direction of the arrow 14, wherein two vertical guides 23 guarantee the vertical position thereof. Each of the side panels 18 has a semicircular plate cut-out 24 and is coupled in this region with the deflecting axle 13 of the two transport chain deflecting wheels 12 by way of a first flange 26 of a bearing housing 25 and by way of a roller bearing 28. A relative displacement between the transport chain deflecting wheels 12 and the roller guide elements 19, 20 fastened to the side panels 18 is thereby avoided when the deflecting axle 13 is displaced for tensioning the transport chain 11.

Figure 4:
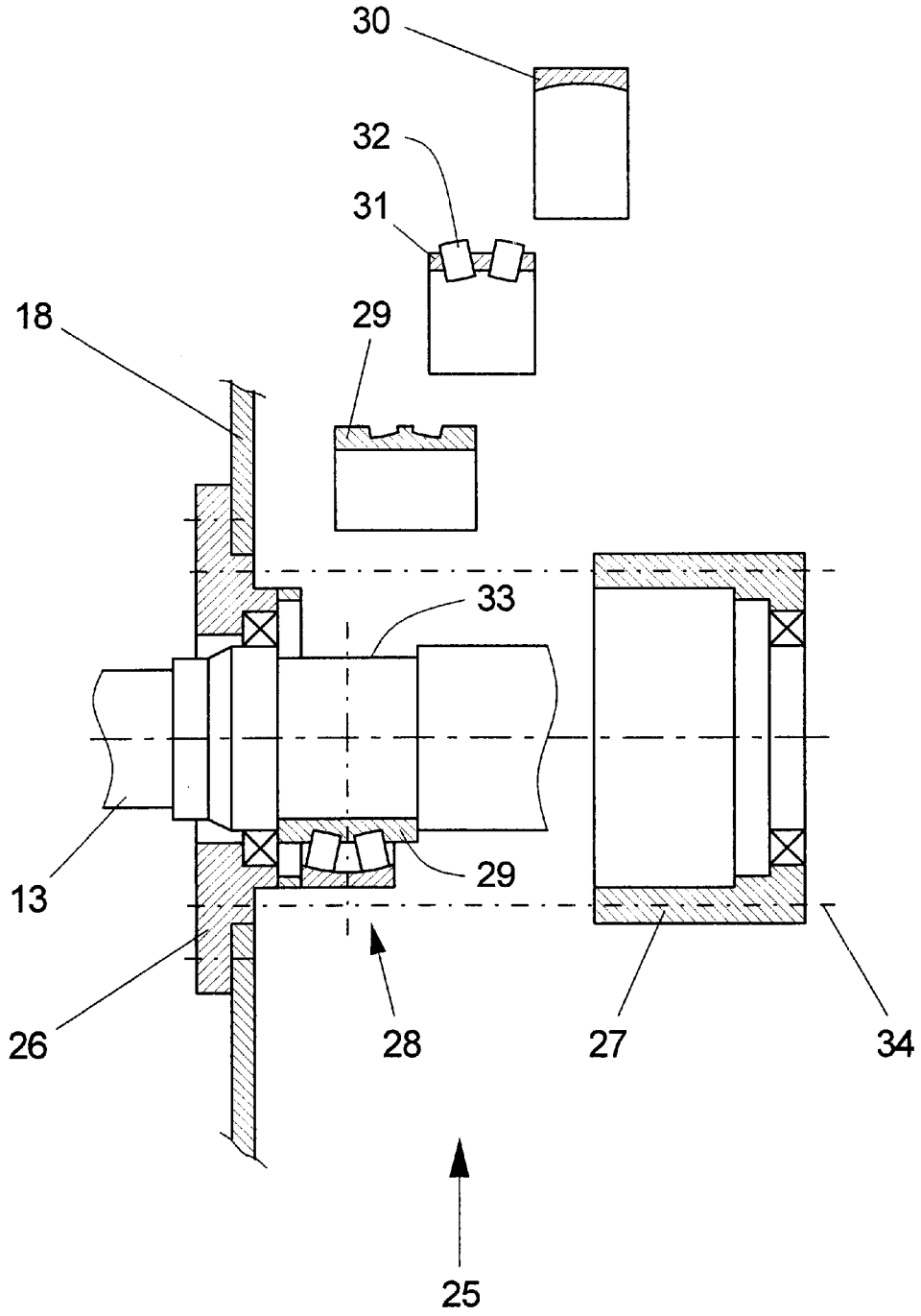
FIG. 4 shows, in detail, the roller bearing arrangement which forms the coupling between the guide equipment and deflecting axle of the transport chain deflecting wheels.

FIG. 4 shows details of the roller bearing connection between each side panel 18 and the deflecting axle 13 of the transport chain deflecting wheels. This roller bearing connection comprises a bearing housing 25 having a first flange 26 and a second flange 27 of hollow cylindrical shape, the flanges being flanged to one another in the mounted state at end faces by means of connecting screws 34, and a divided roller bearing 28 consisting of two respective half-shell-shaped halves of an inner ring 29, an outer ring 30 and a roller body cage 31 with roller bodies 32 retained in the roller body cage. Constructional details of this divided roller bearing 28 are not illustrated here, since it is a usual commercial constructional element. The half-shell-shaped halves of such a roller bearing are mountable on the deflecting axle 13, and demountable therefrom, in a radial direction. In the case of a bearing defect this bearing can therefore be replaced without the deflecting axle 13 having to be demounted for that purpose. In order to carry out such a bearing change, the second flange 27 is detached from the first flange 26 and axially pulled off the inner ring of the roller bearing 28 so that the bearing is freely accessible. The halves of the roller bearing components, which are held together in each case by means of screw connections, are separated and radially removed from the deflecting axle 13. The installation of a replacement bearing takes place in reverse sequence.

The respective two halves of the inner rings 29 of the two roller bearings 28 are seated in a recess 33 of the deflecting axle 13 and thus axially fixed in ideal manner.

Figure 5:
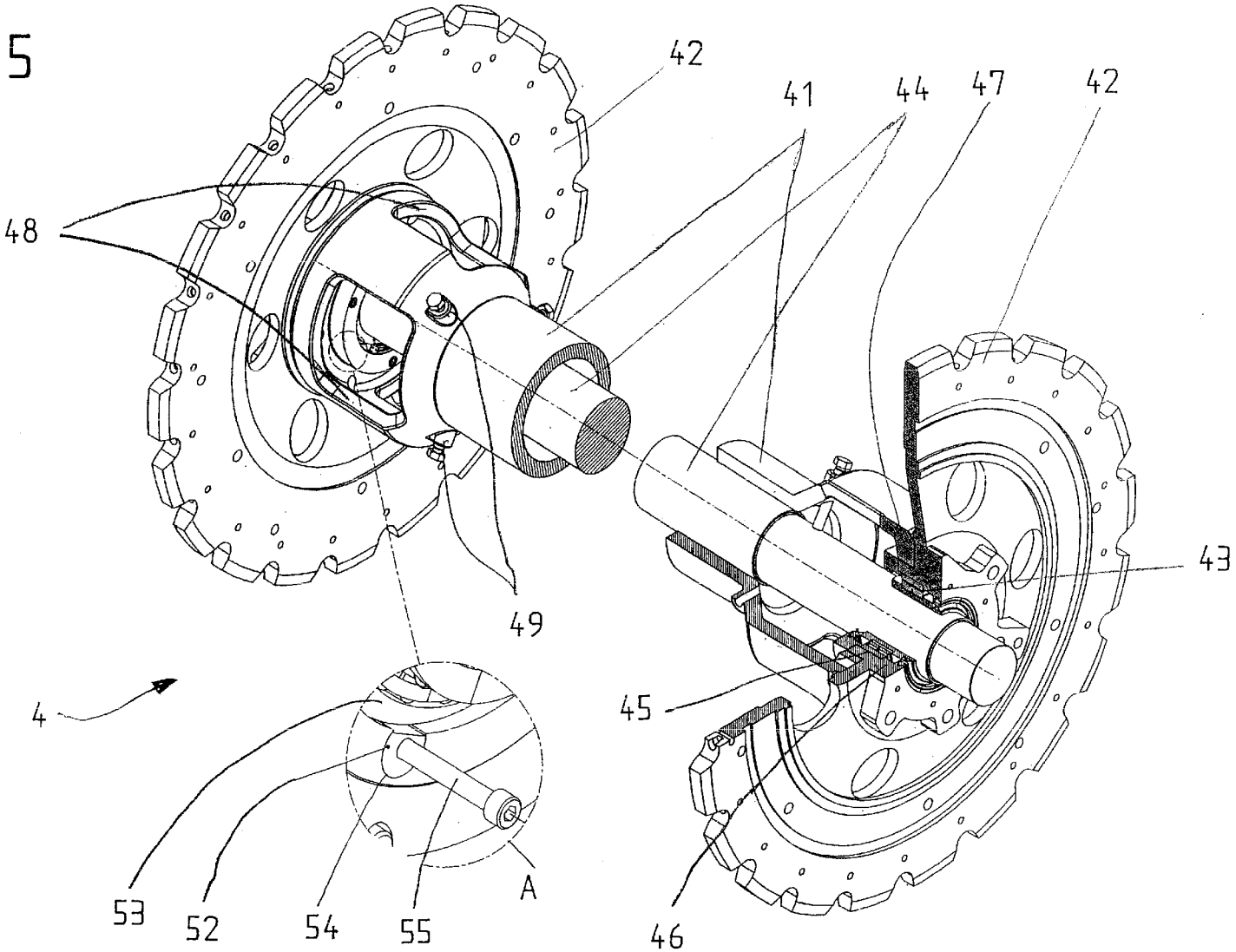
FIG. 5 shows the transport chain drive wheel unit mounted on divided roller bearings.

FIG. 5 shows a second example of use of divided roller bearings in an escalator. Divided roller bearings here serve as the mounting of a transport chain drive wheel unit 4, comprising two transport chain drive wheels 42 which are connected together in a torsionally stiff manner by way of a hollow shaft 41, and drive the transport chains 11, which together with the steps 7 form the step belt 3. The transport chain drive wheel unit 4 is supported by way of two divided roller bearings 43 on a non-rotating central axle 44 fastened at the ends thereof in the support construction 2 of the escalator 1. The roller bearings are, according to FIG. 5, installed in bearing seats 45 of the hubs 46 of the transport chain drive wheels 42. Instead of in the hubs 46 of the transport chain drive wheels 42, these bearing seats could, however, also be integrated in the end flanges 47 of the hollow shaft 41.

The exchange of a divided roller bearing 43 can be carried out without the escalator 1 having to be laterally accessible in the region of the transport chain drive wheel unit 4 and without the latter having to be demounted or the transport chains 11 having to be removed from the transport chain drive wheels 42. Merely two or three steps 7 are demounted from the transport chains 11 in order to make the region of the bearing locations accessible from the inner side of the escalator.

Radially arranged setting screws 49 are located in the transition region between the centre part of the hollow shaft 41 and the bell-shaped end enlargements thereof. The hollow shaft 41 together with the transport chain drive wheels 42 is supported relative to the central axle 44 by these setting screws 49 before a roller bearing exchange, so that during the roller bearing exchange a perfect centring of the transport chain drive wheel unit 4 is maintained.

In the region of its two end flanges 47 the hollow shaft 41 is enlarged in bell shape and provided with three through-openings 48, through which the actions necessary for demounting and installing the divided roller bearing 43 are carried out and the components of the roller bearing 43 removed or reintroduced to the installation location. Detail A shows a withdrawal device 52 for withdrawing the outer ring 53 of the divided roller bearing 43. This detail is described more specifically in connection with FIG. 7.

FIGS. 6 to 10 show details of demounting a divided roller bearing 43 from the above-described transport chain drive wheel unit 4. The reinstallation takes place in reverse sequence.

Figure 6:
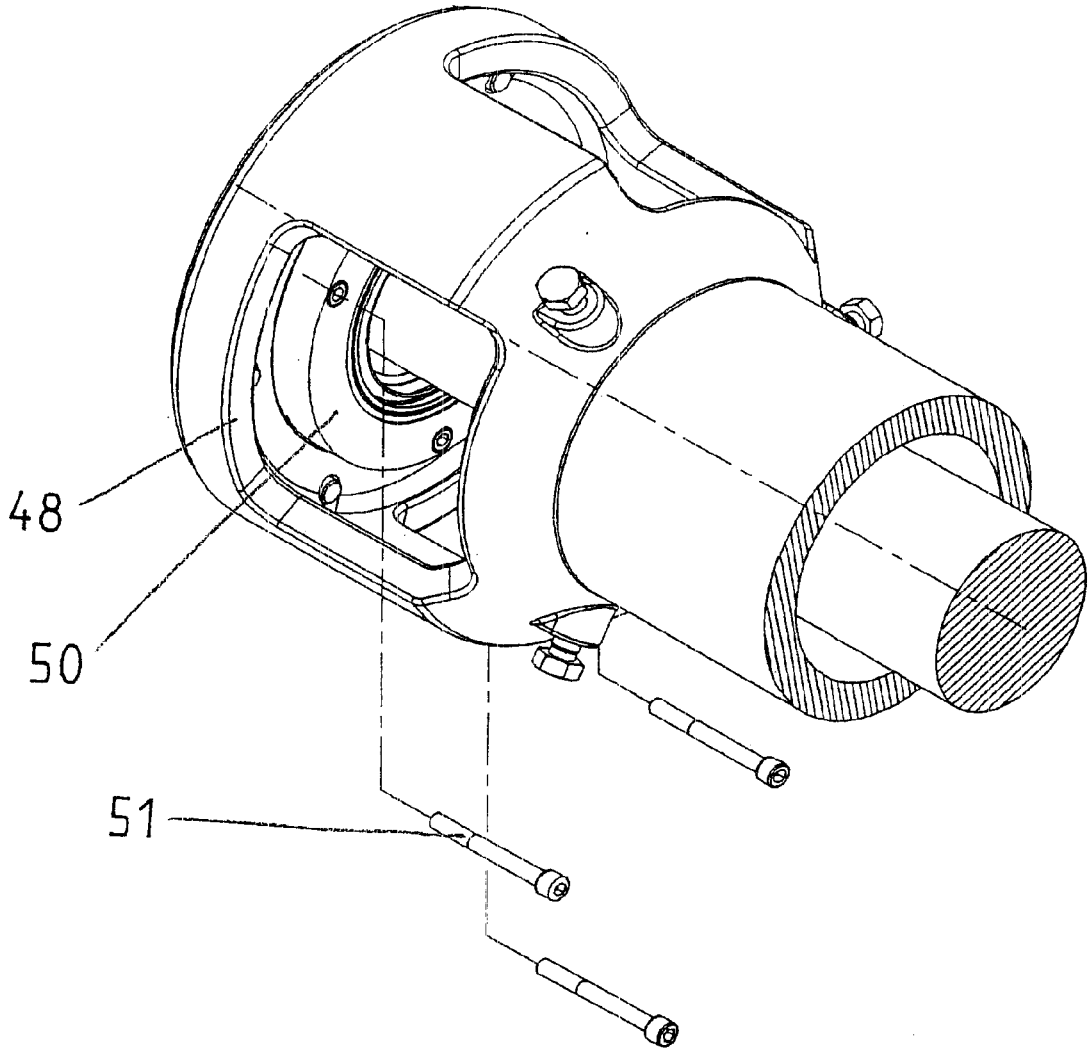
FIGS. 6 to 10 show details with respect to the process of an exchange of a divided roller bearing in the transport chain drive wheel unit.

FIG. 6 shows how the bearing cover 50 is detached by removal of the bearing cover screws 51 so that it can be displaced on the central axle or, if the bearing cover 50 is constructed to be divided in two, can be removed via the through-openings 48.

Figure 7:
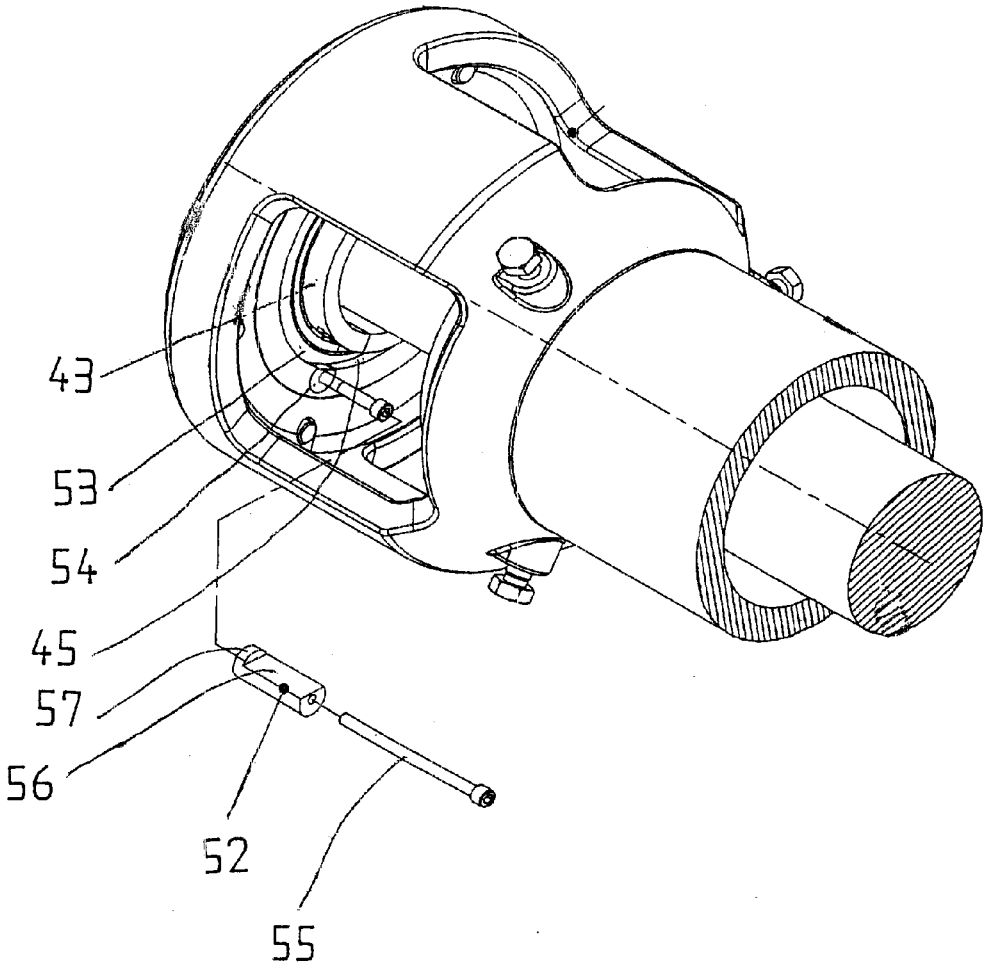

FIG. 7 and detail A in FIG. 5 show how the outer ring 53 of the divided roller bearing 43 is withdrawn from its bearing seat 45 by means of the withdrawal device 52. Bores 54 are arranged in the hub 46 of the transport chain drive wheel 42 (not illustrated here) around the bearing seat 45, which is present therein, to be parallel to the axis of this bearing seat 45. The peripheries of these bores 54 intersect the peripheries of the bearing seat 45, so that a slot parallel to the axis of the bearing seat 45 exists between each bore 54 and the bearing seat 45. A substantially cylindrical withdrawal device 52, which has an axial internal thread into which a withdrawal screw 55 is introduced if needed, is inserted into each bore 54 before mounting of the roller bearing 43. The withdrawal device 52 has a flat 56 which extends parallel to its axis and which prevents the per se cylindrical body from protruding into the region of the bearing seat 45, wherein the flat extends in longitudinal direction only to such an extent that the full cylinder diameter is maintained, in the form of a kind of nose 57, at one end of the withdrawal device 52. This nose 57 engages behind that end face of the outer ring 53 of the roller bearing 43 which lies more deeply in the bearing seat 45. For withdrawal of the roller bearing 43 initially all withdrawal screws 55 are screwed in until their forward ends hit the bases of the bores 54, so that on further rotation the withdrawal device 52 is urged out of the bores 55 and draws, by the nose 57 thereof, the outer ring 53 and thus the entire roller bearing 43 out of the bearing seat 45.

Figure 8:
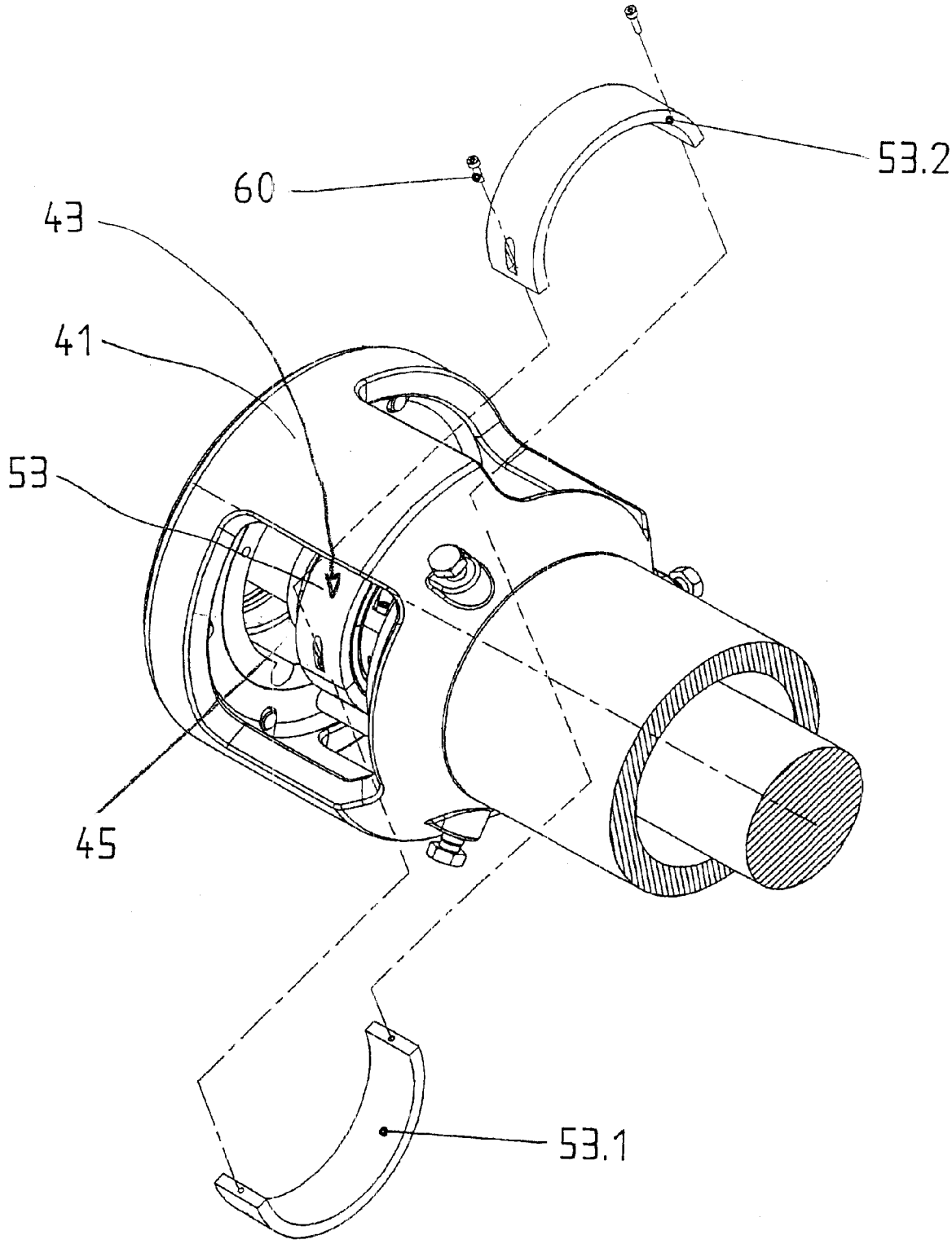

In FIG. 8 it is illustrated how, with the roller bearing 43 withdrawn from the bearing seat 45, the outer ring 53 is divided into two half shells 53.1 and 53.2 by demounting the outer ring screws 60, the half shells being subsequently removed from the region of the hollow shaft 51 via the through-openings 48.

Figure 9:
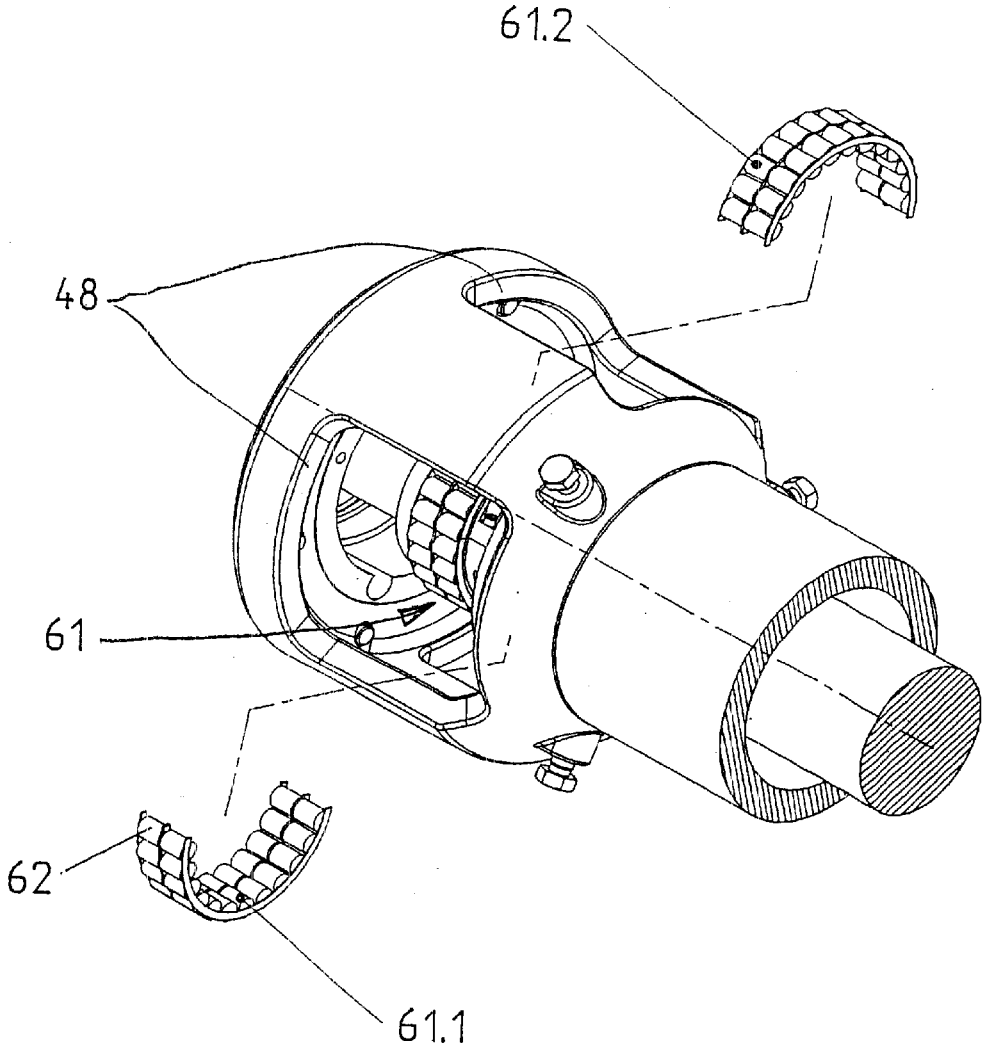

FIG. 9 shows how, after demounting the outer ring 53, the roller body cage 61 divided into two roller body cage halves 61.1 and 61.2 is removed, together with its roller bodies 62, via the through-openings 48.

Figure 10:
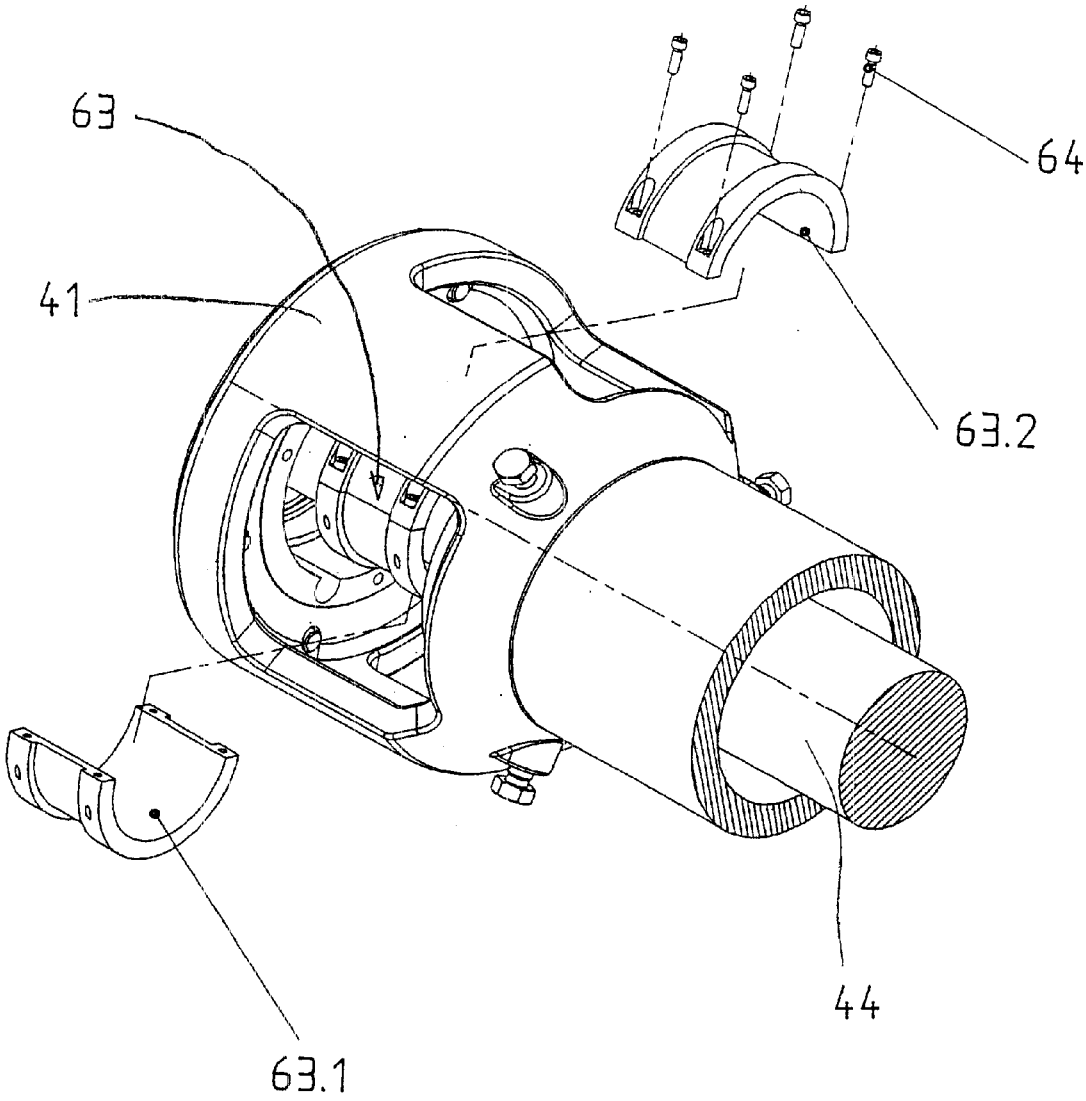

In FIG. 10 it is seen how, as last components of the divided roller bearing 43 to be demounted, the inner ring 63 thereof seated on the central axle 44 is divided into two half shells 63.1 and 63.2 by undoing the inner ring screws 64 and is removed from the region of the hollow shaft 41 via the through-openings 48.

We claim:

1. An escalator or moving walkway, comprising at least one roller bearing which is mounted between an axle or a shaft and at least one further constructional element, characterized in that the roller bearing is a divided roller bearing comprising an inner ring, a roller body cage and an outer ring, each of the inner and outer rings and roller body cage being divided into two halves and being fitted in a radial direction upon the axle or shaft.

2. The escalator or moving walkway according to claim 1, comprising step guide equipment for guiding escalator steps or moving walkway pallets, the guide equipment being coupled to an axle by way of at least one divided roller bearing.

3. The escalator or moving walkway according to claim 2, characterized in that the axle is displaceable transversely to an axial direction thereof.

4. The escalator or moving walkway according to claim 2 or 3, characterized in that the divided roller bearing is mounted on the axle and seated in a bearing housing comprising two flanges, one flange being of hollow cylindrical shape and which receives the entire divided roller bearing.

5. The escalator or moving walkway according to claim 4, characterized in that the flanges are each flanged to the other at a respective end face and are screw-connected together.

6. The escalator or moving walkway according to claim 1 or 2, characterized in that the divided roller bearing comprises an inner ring, wherein the inner ring is mounted in a recess in the axle or shaft, wherein the recess has a width corresponding to a width of the inner ring.

7. The escalator or moving walkway according to claim 1, comprising transport chain drive wheels for driving a step belt or a pallet belt and a further divided roller bearing, upon which the transport chain drive wheels are mounted.

8. The escalator or moving walkway according to claim 7, characterized in that the axle is stationary.

9. The escalator or moving walkway according to claim 7 or 8, characterized in that the transport chain drive wheels are connected together by a hollow shaft.

10. The escalator or moving walkway according to claim 9, characterized in that the hollow shaft has radial through-openings in the two end regions thereof.

11. The escalator or moving walkway according to claim 9, characterized in that the hollow shaft has at least two groups of radially arranged threads for setting screws.

12. The escalator or moving walkway according to claim 9, characterized in that at least one of the divided roller bearings is mounted in a bearing seat, wherein the roller bearing has an outer ring fixedly retained in the bearing seat and wherein channels are arranged around the bearing seat to be parallel to an axis thereof, the channels containing withdrawal devices, which engage behind an end face of the divided roller bearing, for withdrawing the roller bearing from its bearing seat.

* * * * *